US011560892B2

(12) United States Patent
Wang et al.

(10) Patent No.: US 11,560,892 B2
(45) Date of Patent: Jan. 24, 2023

(54) MULTI-STAGE COMPRESSOR AND AIR CONDITIONER HAVING A LINKAGE BETWEEN THE VANES OF THE DIFFERENT STAGES

(71) Applicant: GREEN REFRIGERATION EQUIPMENT ENGINEERING RESEARCH CENTER OF ZHUHAI GREE CO., LTD., Guangdong (CN)

(72) Inventors: Dahao Wang, Qianshan Zhuhai (CN); Huijun Wei, Qianshan Zhuhai (CN); Hongwei Zhu, Qianshan Zhuhai (CN); Jing Liu, Qianshan Zhuhai (CN)

(73) Assignee: GREEN REFRIGERATION EQUIPMENT ENGINEERING RESEARCH CENTER OF ZHUHAI GREE CO., LTD., Guangdong (CN)

( * ) Notice: Subject to any disclaimer, the term of this patent is extended or adjusted under 35 U.S.C. 154(b) by 312 days.

(21) Appl. No.: 16/633,579

(22) PCT Filed: Jun. 12, 2018

(86) PCT No.: PCT/CN2018/090815
§ 371 (c)(1),
(2) Date: Jan. 23, 2020

(87) PCT Pub. No.: WO2019/100697
PCT Pub. Date: May 31, 2019

(65) Prior Publication Data

US 2020/0277957 A1 Sep. 3, 2020

(30) Foreign Application Priority Data

Nov. 23, 2017 (CN) ..... 201711182658.9

(51) Int. Cl.
*F04C 23/00* (2006.01)
*F04C 18/356* (2006.01)
*F01C 21/08* (2006.01)

(52) U.S. Cl.
CPC ..... *F04C 23/003* (2013.01); *F01C 21/089* (2013.01); *F01C 21/0827* (2013.01); *F04C 18/3564* (2013.01); *F04C 2240/60* (2013.01)

(58) Field of Classification Search
CPC ..... F01C 21/089; F01C 21/0827; F01C 21/0809; F04C 18/3564; F04C 23/003; F04C 23/001
See application file for complete search history.

(56) References Cited

U.S. PATENT DOCUMENTS 8,251,682 B2 * 8/2012 Hasegawa ..... F04C 23/008 417/310

FOREIGN PATENT DOCUMENTS

CN 105422450 A 3/2016
CN 105736375 A * 7/2016 ..... F04C 18/356
(Continued)

OTHER PUBLICATIONS

International Search Report for Application No. PCT/CN2018/090815 dated Sep. 18, 2018 (4 pages).

*Primary Examiner* — Mary Davis
(74) *Attorney, Agent, or Firm* — J. Miguel Hernandez; James R. Gourley; Carstens, Allen & Gourley, LLP

(57) ABSTRACT

The present disclosure provides a multi-stage compressor and an air conditioner having the same. The multi-stage compressor includes: a first-stage cylinder including a first-stage compression cavity and a first vane disposed in the first-stage compression cavity; a second-stage cylinder including a second-stage compression cavity and a second vane disposed in the second-stage compression cavity, wherein a refrigerant flowing out from the first-stage com-
(Continued)

pression cavity enters the second-stage compression cavity; a linkage structure disposed between the first vane and the second vane, so that the second vane is capable of moving with a movement of the first vane and maintain contact with a roller in the second-stage compression cavity.

11 Claims, 4 Drawing Sheets

(56) References Cited

FOREIGN PATENT DOCUMENTS

| | | | | | |
|---|---|---|---|---|---|
| CN | 105805003 | A | | 7/2016 | |
| CN | 107989794 | A | | 5/2018 | |
| CN | 207500123 | U | | 6/2018 | |
| JP | H04252890 | A | | 9/1992 | |
| JP | H10299679 | A | * | 11/1998 | |
| JP | H1122678 | A | * | 1/1999 | |
| JP | H11166494 | A | * | 6/1999 | |
| JP | 2000073951 | A | | 3/2000 | |
| JP | 2003201981 | A | * | 7/2003 | ..... F04C 18/3564 |
| JP | 2014134152 | A | * | 7/2014 | |

* cited by examiner

MULTI-STAGE COMPRESSOR AND AIR CONDITIONER HAVING A LINKAGE BETWEEN THE VANES OF THE DIFFERENT STAGES

CROSS-REFERENCE TO RELATED APPLICATION

This application is a U.S. National Stage of International Application No. PCT/CN2018/090815, filed on Jun. 12, 2018 and published as WO 2019/100697 on May 31, 2019, which claims priority to Chinese Patent Application No. 201711182658.9, filed with the Chinese Patent Office on Nov. 23, 2017. Each application, publication, and patent listed in this paragraph are hereby incorporated by reference in their entireties.

TECHNICAL FIELD

The present disclosure relates to the technical field of air conditioning, and more particularly, to a multi-stage compressor and an air conditioner having the same.

BACKGROUND

In a conventional two-stage rotary rotor compressor, generally one of the cylinders is a low-pressure-stage cylinder, and the other cylinder is a high-pressure-stage cylinder. An intermediate cavity is provided between the high-pressure-stage cylinder and the low-pressure-stage cylinder. A refrigerant is drawn from a suction port of an accumulator into the low-pressure-stage cylinder, and then discharged to the intermediate cavity after a first-stage compression. An enthalpy-increasing gas that has been throttled is introduced into the intermediate cavity through an enthalpy-increasing component of the refrigerating system, and is mixed with the gas discharged from the first-stage compression. The mixed gas is drawn from the intermediate cavity into the high-pressure-stage cylinder to have a second-stage compression.

Backsides of vanes in the high-pressure cavity and the low-pressure cavity of the two-stage rotary rotor compressor are both subjected to high pressures. A contact stress between the vane and a roller is mainly determined by a pressure difference between the backside of the vane and a head surface of the vane. The two-stage compressor performs two compressions. Compared with the ordinary single-stage compressor under the same condition, especially under a light load condition (e.g. when the pressure difference between suction and exhausting is small), the two-stage compressor has an intermediate gas compensation, so that the pressure difference between suction and exhausting is shared by the two cylinders, and the pressure difference between the low-pressure-stage and the high-pressure-stage is further reduced. In the low-pressure-stage, the suction is under a suction pressure, and the pressure at the backside of the vane is the exhausting pressure. The pressure difference between the backside and the head surface RB of the low-pressure-stage vane is relatively large. The contact stress between the low-pressure-stage vane and the roller is higher than that in the ordinary compressor. In the high-pressure-stage, the suction is under an intermediate pressure, and the pressure at the backside of the vane is the exhausting pressure. The pressure at the head surface of the vane is larger than that in the ordinary compressor. In the two-stage compressor, the pressure difference between the backside and the head surface of the high-pressure-stage vane is relatively small. The contact stress between the high-pressure-stage vane and the roller is much lower than that in the ordinary compressor.

The pressure difference is gradually established after the compressor is started. During a starting and a stable operation under the condition of the small pressure difference of the two-stage compressor, the high-pressure-stage vane is prone to have an insufficient contact stress to the roller, and detached from the roller. As such, the vane may strike the roller during working, which may cause an abnormal noise during the starting and the operation of the compressor. Besides, the impact between the high-pressure-stage vane and the roller may cause an abnormal trace on an outer cylinder of the roller and the head surface of the vane, which may seriously affect a long-term reliability of the compressor, which is a key and difficult problem that those skilled in the art need to solve promptly.

SUMMARY

According to one aspect of the present disclosure, a multi-stage compressor is provided. The multi-stage compressor includes a first-stage cylinder, a second-stage cylinder, and a linkage structure. The first-stage cylinder includes a first-stage compression cavity and a first vane disposed in the first-stage compression cavity. The second-stage cylinder includes a second-stage compression cavity and a second vane disposed in the second-stage compression cavity A refrigerant flowing out from the first-stage compression cavity enters the second-stage compression cavity, the linkage structure is disposed between the first vane and the second vane, so that the second vane is capable of moving with a movement of the first vane and maintaining contact with a roller in the second-stage compression cavity In an embodiment, the linkage structure includes a connecting rod, a first sliding groove, a first pin shaft, a second sliding groove, and a second pin shaft. The connecting rod is rotatable. One of the first sliding groove and the first pin shaft is located on the connecting rod. The other of the first sliding groove and the first pin shaft is located on the first vane. One of the second sliding groove and the second pin shaft is located on the connecting rod. The other of the second sliding groove and the second pin shaft is located on the second vane.

In an embodiment, a partition plate is further disposed between the first-stage compression cavity and the second-stage compression cavity. The connecting rod is pivotally connected with the partition plate through a third pin shaft. The first sliding groove and the second sliding groove are respectively located on two sides of the third pin shaft. The first pin shaft extends through the first sliding groove and the first vane. The second pin shaft extends through the second sliding groove and the second vane.

In an embodiment, the first vane defines a first pin hole having the first pin shaft extending therethrough. A diameter d1 of the first pin shaft and a diameter D1 of the first pin hole satisfies $0.016\ mm<D1-d1<0.026\ mm$.

In an embodiment, the second vane defines a second pin hole having the second pin shaft extending therethrough. A diameter d2 of the second pin shaft and a diameter D2 of the second pin hole satisfies $0.016\ mm<D2-d2<0.026\ mm$.

In an embodiment, the connecting rod defines a third pin hole having the third pin shaft extending therethrough. A diameter d3 of the third pin shaft and a diameter D3 of the third pin hole satisfies $0.016\ mm<D3-d3<0.026\ mm$.

In an embodiment, the multi-stage compressor further includes a crankshaft. The crankshaft includes a base shaft, a first eccentric and a second eccentric that are offset from an axis of the base shaft. The first eccentric is disposed in the first-stage cylinder to drive a roller in the first-stage compression cavity. The second eccentric is disposed in the second-stage cylinder to drive another roller in the second-stage compression cavity. A phase angle of the first eccentric and that of the second eccentric differ by 180°.

In an embodiment, when an angle between the first eccentric and the first vane is 0° and an angle between the second eccentric and the second vane is 180°, the first pin shaft is located at an end of the first sliding groove away from the third pin shaft. When the angle between the first eccentric and the first vane is 180° and the angle between the second eccentric and the second vane is 0°, the second pin shaft is located at an end of the second sliding groove away from the third pin shaft.

In an embodiment, the first sliding groove and the second sliding groove are located on the connecting rod. A projection of an axis of the first pin shaft on the first vane is located at an axis of symmetry of the first vane, and/or a projection of an axis of the second pin shaft on the second vane is located at an axis of symmetry of the second vane.

In an embodiment, a distance H between an end of the first sliding groove adjacent to the third pin shaft and an end of the second sliding groove adjacent to the third pin shaft and a thickness h of the partition plate satisfy: $H<h$.

In an embodiment, the first pin shaft is integrally formed with the first vane, and/or the second pin shaft is integrally formed with the second vane.

In an embodiment, an elastic member is disposed between the first vane and a side wall of the first-stage compression cavity.

According to another aspect of the present disclosure, an air conditioner including the above-mentioned multi-stage compressor is provided.

By applying the embodiments of the present disclosure, the linkage structure is disposed between the serially connected first-stage cylinder and the second-stage cylinder. The linkage structure is disposed between the first vane and the second vane. When the first vane moves under a pressure, the second vane moves with the first vane under an action of the linkage structure. There is a correlation between a motion trajectory of the first vane and that of the second vane, so that the second vane can maintain contact with the roller in the second compression cavity by the action of the linkage structure. Therefore, a situation that the second vane separates from the roller and then strikes the roller will not happen, thereby reducing the noise of the compressor and avoiding the damage to the roller caused by the second vane striking the roller in the second compression cavity, which affects a long-term operation reliability of the compressor.

BRIEF DESCRIPTION OF THE DRAWINGS

The accompanying drawings, which form a part of the present disclosure, are used to provide a further understanding of the present disclosure. The schematic embodiments of the present disclosure and the descriptions thereof are used to explain the present disclosure, and do not constitute an improper limitation to the present disclosure. In the drawings.

Figure 1:
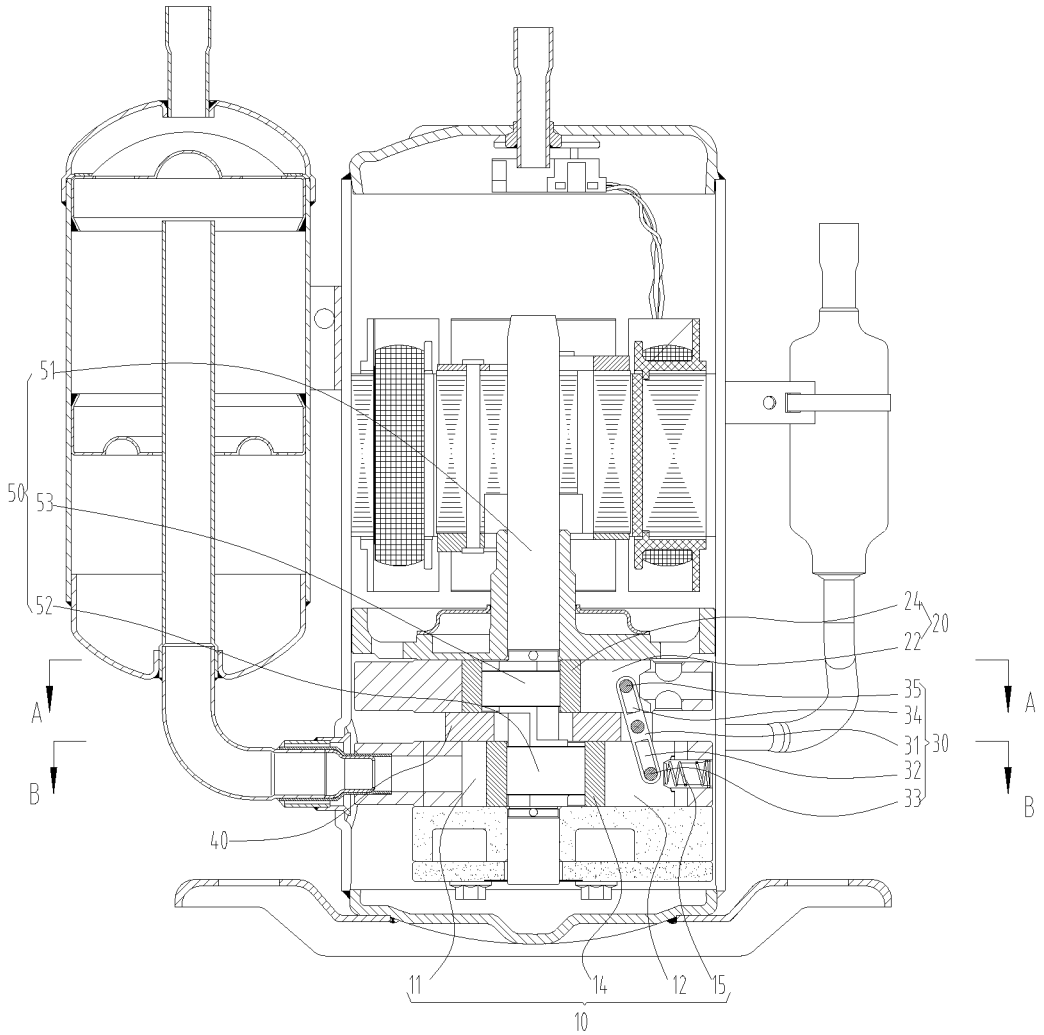
FIG. 1 is a schematic cross-sectional view of an embodiment of a multi-stage compressor according to the present disclosure.

The reference numbers in the drawings are as follows:

10. first-stage cylinder; 11. first-stage compression cavity; 12. first vane; 13. first pin hole; 14. roller; 15. spring; 20. second-stage cylinder; 21. second-stage compression cavity; 22. second vane; 23. second pin hole; 24. roller; 30. linkage structure; 31. connecting rod; 32. first sliding groove; 33. first pin shaft; 34. second sliding groove; 35. second pin shaft; 36. third pin shaft; 37. third pin hole; 40. partition plate; 50. crankshaft; 51. base shaft; 52. first eccentric; 53. second eccentric.

DETAILED DESCRIPTION OF EMBODIMENTS

The technical solutions in the embodiments of the present disclosure will be clearly and completely described below with reference to the accompanying drawings in the embodiments of the present disclosure. Obviously, the described embodiments are only a part of the embodiments of the present disclosure, not all of the embodiments. The following description of at least one exemplary embodiment is merely illustrative in nature and is not intended to limit the disclosure and its application or use. All other embodiments obtained by persons skilled in the art based on the embodiments of the present disclosure without creative efforts shall fall within the protection scope of the present disclosure.

It should be noted that the terminologies used herein are only intended to describe specific embodiments and not intended to limit the exemplary embodiments according to the present disclosure. As used herein, the singular forms are intended to include the plural forms as well, unless the context clearly indicates otherwise. It should also be understood that when the terms of "include" and/or "comprise" are used in the present disclosure, they indicate to have features, steps, operations, devices, assemblies, and/or combinations thereof.

Unless specifically stated otherwise, the relative arrangement of components and steps, numerical expressions, and numerical values set forth in these embodiments do not limit the scope of the present disclosure. Besides, it should be understood that, for the convenience of description, the dimensions of the various parts shown in the accompanying drawings are not drawn according to the actual proportional relationship. Techniques, methods, and equipment known to those skilled in the relevant art may not be discussed in detail, but where appropriate, the techniques, methods, and equipment should be considered as a part of the specification. In all examples shown and discussed herein, any specific value should be construed as exemplary only and not be construed as a limitation. Therefore, other examples of the exemplary embodiments may have different values. It should be noted that similar reference numerals and letters indicate similar items in the following accompanying drawings, so once an item is defined in one drawing, it need not be discussed further in subsequent drawings.

Figure 2:
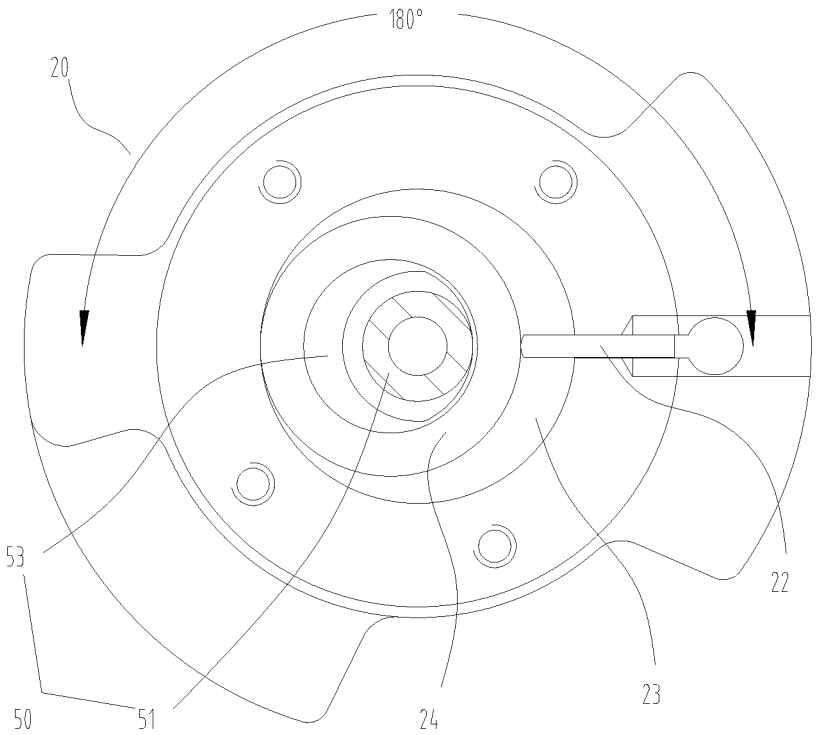
FIG. 2 is a schematic cross-sectional view of the multi-stage compressor of FIG. 1 in an A-A direction.
Figure 3:
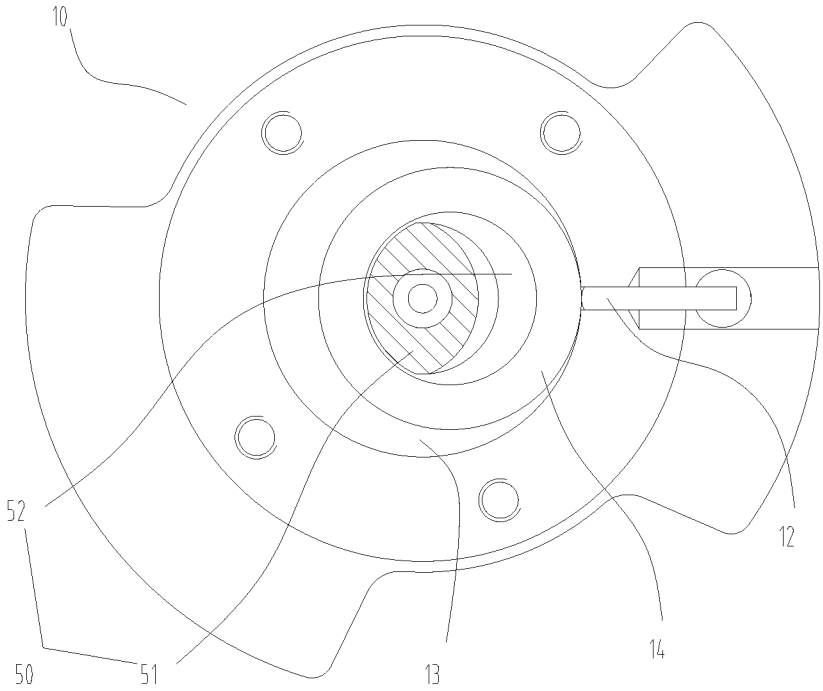
FIG. 3 is a schematic cross-sectional view of the multi-stage compressor of FIG. 1 in a B-B direction.

As shown in FIGS. 1 to 3, a multi-stage compressor in the present embodiment is a two-stage compressor including a first-stage cylinder 10, a second-stage cylinder 20, and a linkage structure 30. The first-stage cylinder 10 includes a first-stage compression cavity 11 and a first vane 12 disposed in the first-stage compression cavity 11. The second-stage cylinder 20 includes a second-stage compression cavity 21 and a second vane 22 disposed in the second-stage compression cavity 21. The first-stage cylinder 10 is a low-pressure-stage cylinder. The second-stage cylinder 20 is a high-pressure-stage cylinder. A refrigerant flowing out from the first-stage compression cavity 11 enters the second-stage compression cavity 21. The linkage structure 30 is disposed between the first vane 21 and the second vane 22, so that the second vane 22 can move with a movement of the first vane 21 and maintain contact with a roller 24 in the second-stage compression cavity 21.

By applying the technical solution of the present embodiment, the linkage structure 30 is disposed between the serially connected first-stage cylinder 10 and second-stage cylinder 20. The linkage structure 30 is disposed between the first vane 12 and the second vane 22. When the first vane 12 moves under a pressure, the second vane 22 moves with the first vane 12 under an action of the linkage structure 30. There is a correlation between a motion trajectory of the first vane 12 and that of the second vane 22, so that the second vane 22 can maintain contact with the roller 24 in the second compression cavity 21 by the action of the linkage structure 30. Therefore, a situation that the second vane 22 separates from the roller 24 and then strikes the roller 24 will not happen, thereby reducing the noise of the compressor and avoiding the damage to the roller 24 caused by the second sliding vane 22 striking the roller 24 in the second compression cavity 21, which affects a long-term operation reliability of the compressor.

Figure 4:
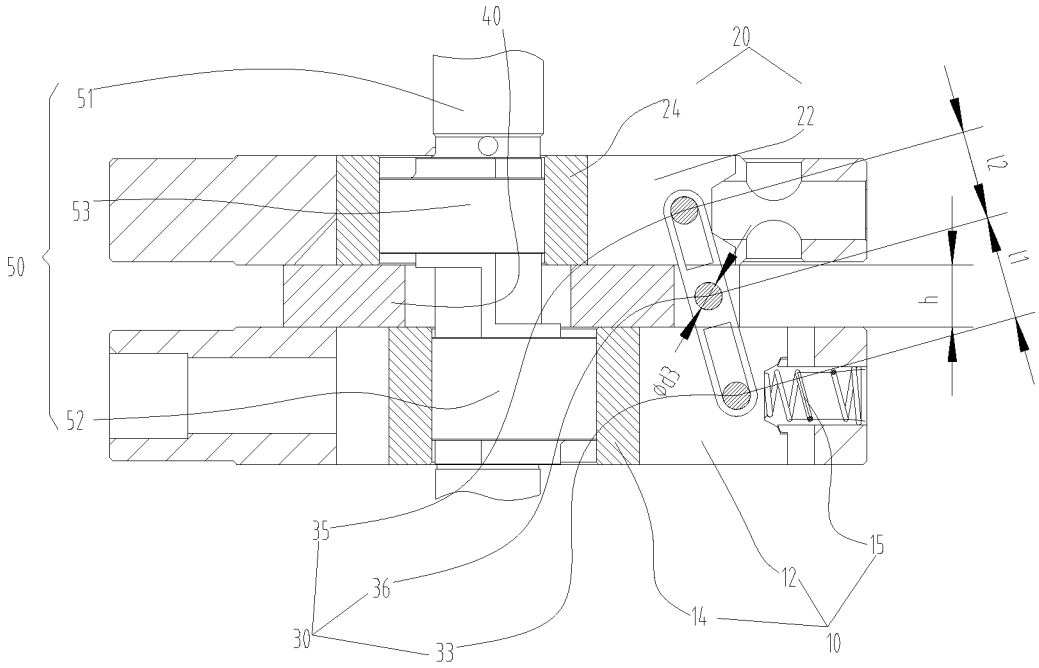
FIG. 4 is a schematic partially enlarged view of the multi-stage compressor of FIG. 1.
Figure 5:
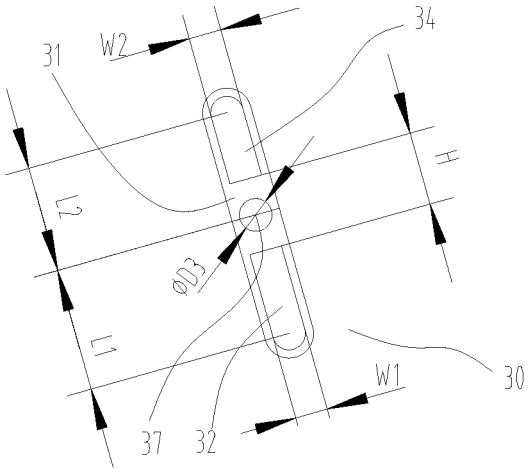
FIG. 5 is a schematic structural view of a connecting rod of the multi-stage compressor of FIG. 4.

Specifically, as shown in FIGS. 1, 4, and 5, the linkage structure 30 of the present embodiment includes a connecting rod 31, a first sliding groove 32, a first pin shaft 33, a second sliding groove 34, and a second pin shaft 35. The connecting rod 31 is rotatable. One of the first sliding groove 32 and the first pin shaft 33 is located on the connecting rod 31; and the other of the first sliding groove 32 and the first pin shaft 33 is located on the first vane 12. One of the second sliding groove 34 and the second pin shaft 35 is located on the connecting rod 31; and the other of the second groove 34 and the second pin shaft 35 is located on the second vane 22. The sliding groove and the pin shaft cooperate with each other to convert a linear motion of the first vane 12 to a linear motion of the second vane 22 through a rotational motion of the connecting rod 31, to keep the second vane 22 always in contact with the roller in the second compression cavity 21. In addition, the linkage structure 30 of the present embodiment achieves the above-mentioned effect by mechanical transmission, so that the operation is reliable.

Figure 8:
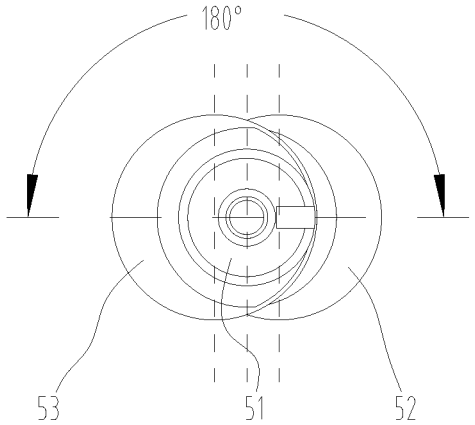
FIG. 8 is a schematic top view of a crankshaft of the multi-stage compressor of FIG. 1.
Figure 9:
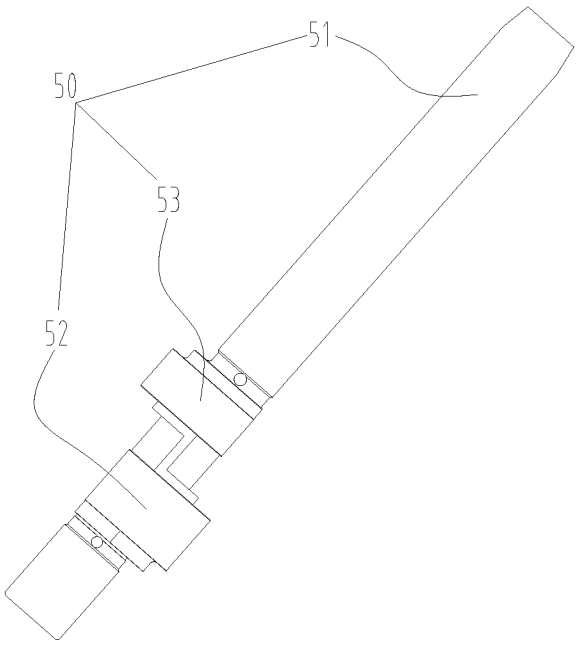
FIG. 9 is a schematic structural view of the crankshaft of the multi-stage compressor of FIG. 1.

Furthermore, as shown in FIGS. 1, 4, and 9, the multi-stage compressor in the present embodiment further includes a crankshaft 50, which includes a base shaft 51, a first eccentric 52 and a second eccentric 53 that are provided offset from an axis of the base shaft 51. The first eccentric 52 is disposed in the first-stage cylinder 10 to drive the roller 14 in the first-stage compression cavity 11. The second eccentric 53 is disposed in the second-stage cylinder 20 to drive the roller 24 in the second-stage compression cavity 21. As shown in FIG. 8, in the present embodiment, a phase angle between the offset direction of the first eccentric 52 relative to the axis of the base shaft 51 and the offset direction of the second eccentric 53 relative to the axis of the base shaft 51 is 180°.

The above structure is beneficial to stabilize a center of gravity of a rotating crankshaft 50, while allowing the movement direction of the first vane 12 to be opposite to that of the second vane 22. When the first vane 12 moves to the left, the second vane 22 moves to the right; and when the first vane 12 moves to the right, the second vane 22 moves to the left. This restricts the movement positions of the first vane 12 and the second vane 22, and avoids the abnormal strikes caused by the separation between the second vane 22 and the roller 24 and the separation between the first vane 12 and the roller 14. Thereby, the problem of the abnormal noise of the two-stage compressor during the starting and the operation under the operating condition of the small pressure difference is solved essentially, and the reliability of the two-stage compressor is improved.

Furthermore, as shown in FIG. 5, in the present embodiment, the first sliding groove 32 and the second sliding groove 34 are defined in the connecting rod 31, so that the first pin shaft 33 and the second pin shaft 35 respectively rotate on the first vane 12 and the second vane 22, and move back and forth on the connecting rod 31, which reduces areas of through holes on the vanes. A partition plate 40 is further disposed between the first-stage compression cavity 11 and the second-stage compression cavity 21. The connecting rod 31 is pivotally connected with the partition plate 40 through a third pin shaft 36. The first sliding groove 32 and the second sliding groove 34 are respectively located at two sides of the third pin shaft 36. The first pin shaft 33 extends through the first sliding groove 32 and the first vane 12. The second pin shaft 35 extends through the second sliding groove 34 and the second vane 22.

Figure 6:
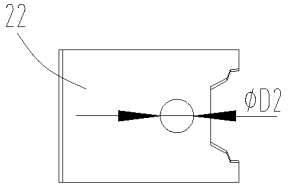
FIG. 6 is a schematic structural view of a second vane of the multi-stage compressor of FIG. 4.
Figure 7:
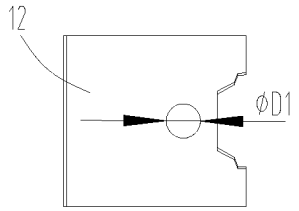
FIG. 7 is a schematic structural view of a first vane of the multi-stage compressor of FIG. 4.

Furthermore, as shown in FIGS. 6 and 7, in the present embodiment, the first vane 12 defines a first pin hole 13 having the first pin shaft 33 extending therethrough. A diameter d1 of the first pin shaft 33 and a diameter D1 of the first pin hole 13 satisfies: $0.016\ mm<D1-d1<0.026\ mm$. The second vane 22 defines a second pin hole 23 having the second pin shaft 35 extending therethrough. A diameter d2 of the second pin shaft 35 and a diameter D2 of the second pin hole 23 satisfies: $0.016\ mm<D2-d2<0.026\ mm$. The connecting rod 31 defines a third pin hole 37 having the third pin shaft 36 extending therethrough. A diameter d3 of the third pin shaft 36 and a diameter D3 of the third pin hole 37 satisfies: $0.016\ mm<D3-d3<0.026\ mm$. In the above-described structure, a gap that is capable of accommodating a lubricant is defined between the pin shaft and the pin hole. The gap and the lubricant in the gap can reduce a friction.

Specifically, in the present embodiment, the two-stage compressor further satisfies: $d1=d2=d3$ and $D1=D2=D3$.

Furthermore, as shown in FIG. 5, in order to have the vanes moving in a sufficiently long space, the sliding grooves shall have a certain length to allow the pin shafts to slide smoothly in the sliding grooves, avoiding limiting the sliding range of the pin shafts and the moving range of the vanes. Specifically, in the present embodiment, a distance H between an end of the first sliding groove 32 adjacent to the third pin shaft 36 and an end of the second sliding groove 34 adjacent to the third pin shaft 36 and a thickness h of the partition plate 40 satisfy $H<h$, to guarantee a sufficient moving range for the pin shafts, thereby making sure that the vanes have a sufficient moving range. In an embodiment, a groove width wl of the first sliding groove 32 is equal to D1, and a groove width w2 of the second sliding groove 34 is equal to D2, to prevent the pin shafts from shaking in the sliding grooves.

When the angle between the offsetting direction of the first eccentric 52 relative to the axis of the base shaft 51 and the first vane 12 is 0°, and the angle between the offsetting direction of the second eccentric 53 relative to the axis of the base shaft 51 and the second vane 22 is 180°, as shown in FIGS. 2 and 3, the first vane 12 is completely retracted into the first-stage cylinder 10, the second vane 22 extends into the second-stage compression cavity 21 with the largest length, and the first pin shaft 33 is located at the end, away from the third pin shaft 36, of the first sliding groove 32. Conversely, when the angle between the offsetting direction of the first eccentric 52 relative to the axis of the base shaft 51 and the first vane 12 is 180°, and the angle between the offsetting direction of the second eccentric 53 relative to the axis of the base shaft 51 and the second vane 22 is 0°, the first vane 12 extends into the first-stage compression cavity 11 with the largest length, the second vane 22 is completely retracted into the second-stage cylinder 20, and the second pin shaft 35 is located at the end, away from the second pin shaft 35, of the second sliding groove 34. Based on the above structure, when the first vane 12 and the second vane 22 move with the rotation of the crankshaft 50 to the extreme locations, the pin shafts can opportunely move to the ends of the sliding grooves and be in contact with the inner walls of the ends, away from the third pin shaft 36, of the sliding grooves, which can prevent the vanes from moving further away from the rollers to separate from the rollers, thereby limiting the moving range of the vanes.

In the present disclosure, the crankshaft 50 adopts the special phase angle difference to facilitate the structural arrangement. In other embodiments not shown in the drawings, the phase angles of the first eccentric and the second eccentric may not be 180°. Accordingly, the specific structure and shape of the linkage structure can be adaptively adjusted according to the motion trajectories of the first vane and the second vane, so that the second vane can be kept in contact with the roller under the action of the linkage structure.

In the present embodiment, a projection of the axis of the first pin shaft 33 on the first vane 12 is located at an axis of symmetry of the first vane 12, and a projection of an axis of the second pin shaft 35 on the second vane 22 is located at an axis of symmetry of the second vane 22, thereby reducing the torque formed on the vanes by the pin shafts, and allowing the vanes to move smoothly.

In other embodiments not shown in the drawings, the first pin shaft can be integrally formed with the first vane, and the second pin shaft can also be integrally formed with the second vane, to reduce the number of parts in the compressor, and improve movement reliability, and be convenient for assembling.

Furthermore, as shown in FIG. 4, in order to have the first vane 12 retracted smoothly, an elastic member is disposed between the first vane 12 and a side wall of the first-stage compression cavity 11. In the present embodiment, the elastic member is a spring 15. In order to fix the position of the spring 15 relative to the first vane 12, or allow the spring 15 to move within an acceptable range, a recess as a limiting portion is formed on the first vane 12. A cross-sectional view of the limiting portion is similar to an R-shape.

The technical solution of the present disclosure can also be applied in a three-stage compressor or a compressor having more than three stages.

The present disclosure also provides an air conditioner. The air conditioner (not shown in the drawings) according to the present embodiment includes a compressor, and the compressor is the above-described two-stage compressor or multi-stage compressor. The air conditioner of the present embodiment has the advantages of low noise and stable operation.

From the above description, it can be seen that the above-described embodiments of the present disclosure achieve the following technical effects:

The linkage structure is disposed between the serially connected first-stage cylinder and second-stage cylinder. The linkage structure is disposed between the first vane and the second vane. When the first vane moves under a pressure, the second vane moves with the first vane under the action of the linkage structure. There is the correlation between a motion trajectory of the first vane and that of the second vane, so that the second vane can maintain contact with the roller in the second compression cavity by the action of the linkage structure. Therefore, a situation that the second vane separates from the roller and then strikes the roller will not happen, thereby reducing the noise of the compressor and avoiding that the damage to the roller caused by the second vane striking the roller in the second compression cavity affects a long-term operation reliability of the compressor.

In the description of the present disclosure, it should be understood that the orientations or positional relationships indicated by the terms, such as "front", "rear", "up", "down", "left", "right", "lateral", "longitudinal", "vertical", "horizontal", "top", "bottom", and etc., are the orientations or positional relationships shown based on the accompanying drawings, and are only intended to facilitate and simplify the description of the present disclosure, rather than intended to indicate or imply that the device or element involved must have the particular orientation or be constructed and operated in the particular orientation, unless otherwise stated. Thus, these terms cannot be understood as a limitation on the protection scope of the present disclosure. Besides, the terms of "inside" and "outside" refer to the inside and outside relative to the outline of each component itself.

For facilitating the description, terms that express relative spatial concepts, such as "on", "over", "on the upper surface of", "above", and etc., can be used here to describe the spatial location relationship between one device or feature and other devices or features shown in the drawings. It should be understood that the terms that express relative spatial concepts are intended to include the different orientations in use or operation in addition to the orientation of the device as described in the drawings. For example, if a device in the drawings is turned over, devices described as "over" or "above" other devices or constructions will be positioned "beneath" or "below" other devices or constructions. Thus, the exemplary term of "above" can include both directions of "above" and "below". The device can also be positioned in other different ways (to be rotated 90 degrees or on other orientations), and the relative description of space used here is explained accordingly.

In addition, it should be noted that the terms, such as "first", "second", etc., used to limit parts are only intended to facilitate the differentiation of the corresponding parts. Unless otherwise stated, the above terms have no special meaning, and cannot be understood as limiting the protection scope of the present disclosure.

The above descriptions are merely preferred embodiments of the present disclosure and are not intended to limit the present disclosure. For those skilled in the art, the present disclosure may have various modifications and changes. Any modification, equivalent replacement, and improvement, etc. within the spirit and the principle of the present disclosure, are all supposed to be contained in the scope of protection of the present disclosure.

What is claimed is:

1. A multi-stage compressor, comprising a first-stage cylinder comprising a first-stage compression cavity and a first vane disposed in the first-stage compression cavity;

a second-stage cylinder comprising a second-stage compression cavity and a second vane disposed in the second-stage compression cavity, and a refrigerant flowing out from the first-stage compression cavity enters the second-stage compression cavity;

a linkage structure disposed between the first vane and the second vane, so that the second vane is capable of moving with a movement of the first vane and maintaining contact with a roller in the second-stage compression cavity, wherein the linkage structure comprises a connecting rod, a first sliding groove, a first pin shaft, a second sliding groove, and a second pin shaft, the connecting rod is rotatable, tone of the first sliding groove and the first pin shaft is located on the connecting rod, the other of the first sliding groove and the first pin shaft is located on the first vane, one of the second sliding groove and the second pin shaft is located on the connecting rod, and the other of the second sliding groove and the second pin shaft is located on the second vane; and a partition plate disposed between the first-stage compression cavity and the second-stage compression cavity, wherein the connecting rod is pivotally connected with the partition plate through a third pin shaft, the first sliding groove and the second sliding groove are respectively located on two sides of the third pin shaft, the first pin shaft extends through the first sliding groove and the first vane, and the second pin shaft extends through the second sliding groove and the second vane;

wherein the first sliding groove and the second groove are located on the connecting rod, a projection of an axis of the first pin shaft on the first vane is located at an axis of symmetry of the first vane, and/or the projection of an axis of the second pin shaft on the second vane is located at an axis of symmetry of the second vane; a distance H between an end of the first sliding groove adjacent to the third pin shaft and an end of the second sliding groove adjacent to the third pin shaft and a thickness h of the partition plate satisfy: $H<h$.

2. The multi-stage compressor of claim 1, wherein the first vane defines a first pin hole having the first pin shaft extending therethrough, and a diameter d1 of the first pin shaft and a diameter D1 of the first pin hole satisfies: 0.016 mm<D1-d1<0.026 mm.

3. The multi-stage compressor of claim 1, wherein the second vane defines a second pin hole having the second pin shaft extending therethrough, and a diameter d2 of the second pin shaft and a diameter D2 of the second pin hole satisfies: 0.016 mm<D2-d2<0.026 mm.

4. The multi-stage compressor of claim 1, wherein the connecting rod defines a third pin hole having the third pin shaft extending therethrough, a diameter d3 of the third pin shaft and a diameter D3 of the third pin hole satisfies: 0.016 mm<D3-d3<0.026 mm.

5. The multi-stage compressor of claim 1, further comprising a crankshaft, wherein the crankshaft comprises a base shaft and a first eccentric and a second eccentric offset from an axis of the base shaft, the first eccentric is disposed in the first-stage cylinder to drive a roller in the first-stage compression cavity, the second eccentric is disposed in the second-stage cylinder to drive another roller in the second-stage compression cavity, and a difference between a phase angle of the first eccentric and a phase angle of the second eccentric is 180°.

6. The multi-stage compressor of claim 5, wherein when an angle between the first eccentric and the first vane is 0° and an angle between the second eccentric and the second vane is 180°, the first pin shaft is located at an end of the first sliding groove away from the third pin shaft, and when the angle between the first eccentric and the first vane is 180° and the angle between the second eccentric and the second vane is 0°, the second pin shaft is located at an end of the second sliding groove away from the third pin shaft.

7. The multi-stage compressor of claim 1, wherein the first pin shaft is integrally formed with the first vane, and/or the second pin shaft is integrally formed with the second vane.

8. The multi-stage compressor of claim 1, further comprising an elastic member disposed between the first vane and a side wall of the first-stage compression cavity.

9. An air conditioner comprising a compressor, characterized in that the compressor is the multi-stage compressor of claim 1.

10. The multi-stage compressor of claim 1, wherein the first vane defines a first pin hole having the first pin shaft extending therethrough, and a diameter d1 of the first pin shaft and a diameter D1 of the first pin hole satisfies: 0.016 mm<D1-d1<0.026 mm;

the second vane defines a second pin hole having the second pin shaft extending therethrough, and a diameter d2 of the second pin shaft and a diameter D2 of the second pin hole satisfies: 0.016 mm<D2-d2<0.026 mm; and the connecting rod defines a third pin hole having the third pin shaft extending therethrough, a diameter d3 of the third pin shaft and a diameter D3 of the third pin hole satisfies: 0.016 mm<D3-d3<0.026 mm.

11. The multi-stage compressor of claim 10, wherein d1=d2=d3 and D1=D2=D3.

* * * * *